US008420971B2

(12) United States Patent
Würgler et al.

(10) Patent No.: US 8,420,971 B2
(45) Date of Patent: Apr. 16, 2013

(54) SWITCHING CHAMBER INSULATION ARRANGEMENT FOR A CIRCUIT BREAKER

(75) Inventors: Roland Würgler, Dietlikon (CH); Arben Sabani, Zürich (CH); Vincent Tilliette, Zürich (CH); Walter Holaus, Zürich (CH); Markus Keller, Zürich (CH); Diego Sologuren-Sanchez, Wettingen (CH); René Kallweit, Schaffhausen (CH)

(73) Assignee: ABB Technology AG (CH)

( * ) Notice: Subject to any disclaimer, the term of this patent is extended or adjusted under 35 U.S.C. 154(b) by 135 days.

(21) Appl. No.: 13/117,556

(22) Filed: May 27, 2011

(65) Prior Publication Data

US 2011/0290624 A1 Dec. 1, 2011

(30) Foreign Application Priority Data

May 28, 2010 (EP) ..... 10164240

(51) Int. Cl.
*H01H 33/662* (2006.01)

(52) U.S. Cl.
USPC ..... 218/134; 218/51; 218/119

(58) Field of Classification Search ..... 218/51, 218/119, 134
See application file for complete search history.

(56) References Cited

U.S. PATENT DOCUMENTS

| | | | | |
|---|---|---|---|---|
| 3,641,295 | A | 2/1972 | Ferton et al. | |
| 3,816,682 | A | 6/1974 | MacBeth | |
| 4,449,021 | A * | 5/1984 | Wakayama et al. | 218/119 |
| 4,471,187 | A * | 9/1984 | Sturzenegger et al. | 218/51 |
| 5,321,221 | A * | 6/1994 | Rozier | 218/2 |
| 5,734,140 | A | 3/1998 | Hokuto et al. | |
| 6,437,276 | B1 | 8/2002 | Bruchmann et al. | |
| 2006/0006144 | A1 * | 1/2006 | Moore | 218/150 |
| 2009/0218318 | A1 * | 9/2009 | Gentsch | 218/134 |

FOREIGN PATENT DOCUMENTS

| | | | |
|---|---|---|---|
| CA | 2 360 957 | C | 7/2006 |
| CA | 2 359 786 | C | 2/2009 |
| DE | 1 293 281 | B | 4/1969 |
| DE | 1904389 | A1 | 8/1970 |
| DE | 103 45 657 | A1 | 4/2005 |
| EP | 1519395 | A2 | 3/2005 |
| WO | WO 00/45487 | A1 | 8/2000 |
| WO | 2011086028 | A1 | 7/2011 |

OTHER PUBLICATIONS

Search Report issued on Oct. 14, 2010, by European Patent Office for Application No. 10164240.3.

* cited by examiner

*Primary Examiner* — Truc Nguyen
(74) *Attorney, Agent, or Firm* — St. Onge Steward Johnston & Reens LLC

(57) ABSTRACT

A switching chamber insulation arrangement and a circuit breaker having such a switching chamber insulation arrangement are provided. The switching chamber insulation arrangement provides improved heat dissipation in the area of the contact areas of switch contact poles. The switching chamber insulation arrangement includes a strut arrangement having a plurality of struts. Each strut has a first foot area, a second foot, area and a center area which is located between the first foot area and the second foot area, respectively. The struts are arranged along a circumference around a longitudinal extent axis of the strut arrangement. The strut arrangement has a first mechanical coupling area on a side of the first foot areas for coupling to a first pole of a circuit breaker, and a second mechanical coupling area on a side of the second foot areas for coupling to a second pole of a circuit breaker.

41 Claims, 7 Drawing Sheets

SWITCHING CHAMBER INSULATION ARRANGEMENT FOR A CIRCUIT BREAKER

RELATED APPLICATIONS

This application claims priority under 35 U.S.C. §119 to European patent application No. 10164240.3 filed in Europe on May 28, 2010, the entire content of which is hereby incorporated by reference in its entirety.

FIELD

The present disclosure relates to a switching chamber insulation arrangement. More particularly, the present disclosure relates to a switching chamber insulation arrangement for a circuit breaker with an improved heat dissipation capability.

BACKGROUND INFORMATION

Circuit breakers for switching high voltages and/or high currents in general have contact poles of a complex design. The contact poles can be moved relative to one another in order to carry out a connection or disconnection process. Because of the high voltages and/or currents which occur, it is generally necessary to position the two switch contact poles in a defined manner with respect to one another, such that the corresponding contact surfaces can make contact with one another, and can be disconnected, in a predetermined manner. In order to ensure that the two switch contact poles are positioned correctly, a switching chamber insulation arrangement is provided, which positions the two switching contact poles with respect to one another to ensure geometrically predefined opening and closing of the contact surfaces of the switch contact poles with respect to one another. However, a switching chamber insulation arrangement such as this not only has to ensure that the two switch contacts are mechanically robust with respect to one another, but likewise has to have a dielectric strength, which dielectrically withstands the voltages that occur, for example, when the switch contacts are open. For this purpose, substantially closed tube arrangements have been used until now, to which the two switch contact poles are fixed, thus allowing moving parts of the switch contact poles to be moved toward one another in a defined manner. However, tube arrangements such as these result in spatial compartmentalization of the contact surfaces of the switch contact poles. As a result, heat which is developed cannot reliably be dissipated at the contacts of the switch contact poles in certain operating states.

SUMMARY

An exemplary embodiment of the present disclosure provides a switching chamber insulation arrangement, which includes a strut arrangement having a plurality of struts. Each strut has a first foot area, a second foot, area and a center area which is located between the first foot area and the second foot area, respectively. The struts are arranged along a circumference around a longitudinal extent axis of the strut arrangement. The strut arrangement has a first mechanical coupling area on a side of the first foot areas for coupling to a first pole of a circuit breaker, and a second mechanical coupling area on a side of the second foot areas for coupling to a second pole of a circuit breaker.

BRIEF DESCRIPTION OF THE DRAWINGS

Additional refinements, advantages and features of the present disclosure are described in more detail below with reference to exemplary embodiments illustrated in the drawings, in which.

DETAILED DESCRIPTION

Figure 1:
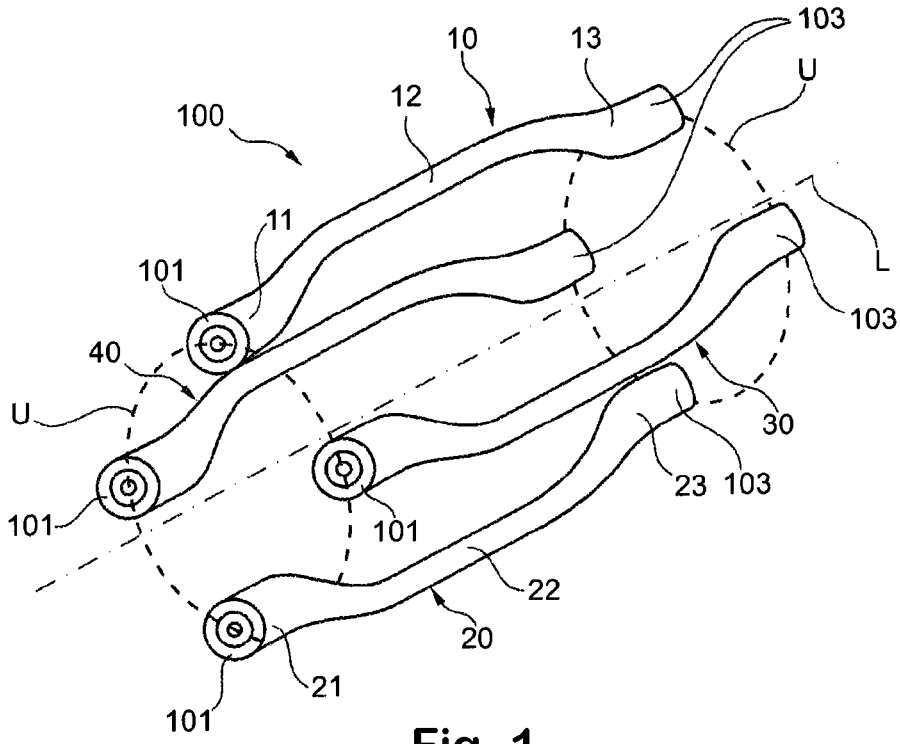
FIG. 1 shows a switching chamber insulation arrangement having a strut arrangement, according to an exemplary embodiment of the present disclosure.

In view of the background discussed above, exemplary embodiments of the present disclosure provide a switching chamber insulation arrangement and a circuit breaker with such a switching chamber insulation arrangement, which allow improved heat dissipation in the area of the switch contact poles.

According to an exemplary embodiment of the present disclosure, a switching chamber insulation arrangement includes a strut arrangement with a plurality of struts, wherein each strut has a first foot area, a second foot area and a center area which is located between the first foot area and the second foot area. The struts are arranged along a circumference around a longitudinal extent axis of the strut arrangement. The strut arrangement has a first mechanical coupling area on the side of the first foot areas for coupling to a first pole of a circuit breaker, and a second mechanical coupling area on the side of the second foot areas for coupling to a second pole of a circuit breaker. In this case, the terms "first pole" and "first contact pole", as well as "second pole" and "second contact pole" of a circuit breaker in the following description do not mean two poles of different electrical phases, but a first contact part and a second part of a single circuit breaker, in which case the first contact part and the second contact part can be electrically disconnected from one another.

Because of the strut arrangement, the area of contact between the two switch contacts is no longer physically compartmentalized from the remaining volume of the switch, but is connected to the remaining volume of the switch. For example, in the case of gas-insulated circuit breakers, it is possible for a gas exchange to occur in the area of the switch contact poles with the remaining gas volume, thus allowing improved heat dissipation to be achieved in the area of the contact points of the switch contact poles. In this case, nevertheless, the strut arrangement allows adequate positioning and force absorption, thereby still ensuring reliable opening and closing of the contact of the switch contact poles. In this case, appropriate mechanical coupling to corresponding areas of the switch contact poles can be achieved via the mechanical coupling areas of the strut arrangement.

According to an exemplary embodiment of the present disclosure, the struts have an elongated cross section in the center area.

As used herein, an "elongated cross section" means a longitudinal extent substantially in the direction of a circumference at right angles to, that is to say azimuthally with respect to, a longitudinal extent axis of the struts or of the strut arrangement. In this case, inter alia, elongated may be, but is not necessarily, oval, elliptical or kidney-shaped. An elongated cross section makes it possible for the struts to have an adequate bending moment, while, however, having only small dimensions in a direction which is radial with respect to the longitudinal extent axis of the strut arrangement, thus making it possible not only to ensure an adequate separation between the live parts of the switch contact poles but also from an outer housing, while at the same time also allowing the radial dimensions to be kept small.

In the case of an exemplary embodiment as an outdoor switch (AIS), the outer housing can be in the form of an insulator. In the case of exemplary embodiments of gas-insulated switchgear assemblies (GIS) or tank switches (DTB), the outer housing can be metallic or at least metal-encapsulated.

According to an exemplary embodiment of the present disclosure, the respective first foot areas and the respective second foot areas are bent through a distance with respect to the corresponding center areas, in a radial direction of the switching chamber insulation arrangement with respect to the longitudinal extent axis.

As used herein, the term "bent" means that the two center axes, that is to say the center axes of the foot areas and the center axes of the center areas, are shifted with respect to one another. In particular, the center areas may in this case be located further radially outward than the foot areas. This makes it possible to fit the foot areas closer to the switch contact poles, while still ensuring an adequate dielectric separation between the contact surfaces and live parts of the switch contact poles and the center areas. This is particularly relevant when the foot areas of the switching chamber insulation arrangement are covered by fuel-controlling elements. This makes it possible to ensure that a circuit breaker with a corresponding switching chamber insulation arrangement is physically compact.

According to an exemplary embodiment of the present disclosure, the first foot area of a respective strut in the strut arrangement is shifted with respect to the associated second foot area in this strut, such that the struts are inclined with respect to the longitudinal extent axis.

For example, the struts may be shaped in a similar manner to a helical section, in order to ensure an adequate separation from the switch poles. This lengthens the effective length of the struts while maintaining the separation between the two mounting planes, which run at right angles to the longitudinal extent direction of the switching chamber insulation arrangement, and in each of which the first and the second foot areas may be located. This results in a lengthened creepage distance along the surface of the respective strut, as a result of which a strut arrangement such as this has a higher surface discharge resistance than a strut arrangement with struts which run parallel to a longitudinal extent direction.

According to an exemplary embodiment of the present disclosure, the strut arrangement can have at least three struts.

This exemplary arrangement allows the two switch contact poles to be positioned in a stable form with respect to one another, for example, when the at least three struts are substantially at the same distance from one another. For example, bending along the longitudinal extent axis can be substantially suppressed. If the struts are in this case inclined with respect to the longitudinal extent axis, this inclination with all of the struts may run in the same direction, thus allowing a symmetrical, helical strut profile to be achieved.

According to an exemplary embodiment of the present disclosure, the strut arrangement has at least four struts, wherein the struts are inclined alternately in opposite senses with respect to the longitudinal extent direction, thus providing stiffening in the circumferential direction around the longitudinal extent axis.

This configuration makes it possible to avoid twisting shifting of the two switch contact poles with respect to one another, with this torsion being achieved substantially by the struts being inclined alternately in opposite senses. The extent of the inclination is in this case governed by the required connection stiffness. Bending and therefore geometric deformation of the struts can be avoided, for example, with respect to forces which occur in the longitudinal extent direction, such as during opening or closing, for example.

According to an exemplary embodiment of the present disclosure, a field control electrode can, in each case, be embedded in the first foot areas and in the second foot areas, with a force absorption apparatus being arranged within the field control electrode.

A force absorption apparatus such as this may, for example, be a thread or a bolt, or else a bayonet connection or a clamping connection. The field control electrode may in this case result in a geometry creating an optimized fuel to the outside, thus making it possible to keep fuel peaks substantially below a critical range. In particular, a metal part with an optimized-field external contour can be provided in the foot areas, and, for example, the force absorption apparatus may be located in its interior, in the form of a thread or some other attachment, such that the force absorption apparatus and the field control electrode are formed integrally.

In this case, the elements of the field control electrode may be composed both of metal and of a material which is at a different potential, for example a plastic to which a potential-carrying additive is added, such as carbon or graphite.

According to an exemplary embodiment of the present disclosure, the first foot areas of the struts are each formed integrally with a first supporting ring, and the second foot areas are each formed integrally with a second supporting ring.

In this case, the supporting rings may run along a circumference which corresponds substantially to the external dimensions of the switch contact poles. This arrangement makes it possible to provide a substantially integral switching chamber insulation arrangement, which can easily be attached to the corresponding switch contact poles without any need to separately align the individual struts with respect to one another. However, the strut arrangement at the same time ensures an appropriate heat dissipation and a gas exchange in a gas-insulated circuit breaker. The bend may in this case be provided both in the area of the struts, that is to say between the foot area and the center part, and in the area of the supporting rings.

According to an exemplary embodiment of the present disclosure, the strut arrangement has a polymer resin, and has a metal-oxide-filled polymer resin in at least one section of an electrical isolating gap.

Polymer resins ensure reliable dielectric strength with mechanical robustness at the same time. An appropriate metal-oxide filling may in this case increase the mechanical robustness, while representing an improved thermal characteristic. By way of example, but not exclusively, an epoxy resin, a polyurethane resin or a phenol resin may be used as polymer resins. In this case, by way of example, aluminum oxide ($Al_2O_3$) may therefore be used as a metal oxide. Furthermore, titanium dioxide or magnesium oxide may also be used. One suitable combination may include, for example, an aluminum-oxide-filled epoxy resin, in which case aluminum oxide is resistant to a certain extent to $SF_6$ and $SF_4$ which occur, for example, in gas-insulated circuit breakers. The strut arrangement may in this case have a homogeneous structure, for example, in the form of a homogeneous encapsulation compound or else may be machined from a homogeneous material. In this case, there would be no need for longitudinal structures such as fiber inserts, particularly if these lead to the expectation of a discharge or partial-discharge problem.

According to an exemplary embodiment of the present disclosure, the center area of at least one strut has a shell which is located radially outside the respective strut, and a filling which is located radially within the respective strut.

In this case, the externally located shell may completely surround the respective strut on the outside, or else may be merely in the form of a half-shell. For example, particularly when using materials which are appropriate and resistant to a tension, a shell can absorb corresponding tensile forces, while an internally located filling can absorb compression forces. Furthermore, a shell can also represent mechanical protection for the internally located filling. This makes it possible to provide a strut arrangement which is particularly resistant to tension and compression force, that is to say it is also resistant to bending, for a switching chamber insulation arrangement.

According to an exemplary embodiment of the present disclosure, the circumference is circular, and/or the switching chamber insulation arrangement can be installed in a single-phase-encapsulated circuit breaker.

In this case, a circular circumference makes it easier to assemble the switching chamber insulation arrangement or the circuit breaker, since there is no need for corresponding radial alignment.

According to an exemplary embodiment of the present disclosure, at least a part of the strut arrangement is coated, for example, with a diffusion barrier.

By way of example, a diffusion barrier such as this may be a titanium dioxide coating or an epoxy resin coating. This makes it possible to prevent aggressive decomposition products, which can occur because of the arc effect in a gas-insulated circuit breaker, from attacking or even destroying the structure of the strut arrangement or of the switching chamber insulation arrangement.

However, instead of having a homogeneous material structure, the center part of the struts may also have a load-bearing core insert, which provides robustness, for example a composite tube, a composite strip or a rod, in which case the filling and/or the strut can be cast around the corresponding tube, the strip or the rod. For instance, the center part of the strut may also have a fiber reinforcing insert, such as in a form that there is no need to be concerned about discharge or partial-discharge processes.

According to an exemplary embodiment of the present disclosure, a circuit breaker is provided having a switching chamber insulation arrangement according to the disclosure, a first switch contact pole and a second switch contact pole. The circuit breaker is a single-phase-encapsulated circuit breaker. The switching chamber insulation arrangement and the first and second switch contact poles cam be connected to one another such that the first and second switch contact poles are aligned and fixed in a defined manner with respect to one another.

According to an exemplary embodiment of the present disclosure, the circuit breaker includes a first field control cover which is arranged at a rated current contact junction (nominal contact). The first field control cover is connected, carrying potential, to the first switch contact pole and/or to the second switch contact pole. The first mechanical coupling area is mechanically connected to the first switch contact pole at the first switch contact pole and/or the second switch contact pole, under the first field control cover.

This configuration allows the attachment elements, which are critical for an electrical field, to be covered by a field control cover such that, essentially, no critical fuel peaks may be expected.

It should be noted that the exemplary embodiments of the present disclosure described in the following text relate equally to the switching chamber insulation arrangement and to the circuit breaker. The individual features may, of course, also be combined with one another, thus in some cases allowing advantageous effects to be achieved, which go beyond the sum of the individual effects. These and other aspects of the present disclosure will be explained and described by reference to the exemplary embodiments described below.

FIG. 1 shows a switching chamber insulation arrangement having a strut arrangement 100 which, in the exemplary embodiment shown here, includes four struts 10, 20, 30, 40, in the form of a longitudinal section. Each of the struts in the exemplary embodiment of FIG. 1 has a center area 12, 22 as well as corresponding first foot areas 11, 21 and second foot areas 13, 23. The switching chamber insulation arrangement 100 shown in FIG. 1 in this case has a first coupling area 101 and a second coupling area 103. The struts are arranged substantially parallel to a longitudinal extent L, with the individual struts and their foot points being arranged along a circumference U. The distance between the struts along the circumference is uniform in the embodiment shown here, but may also be non-uniform, if appropriate. The switching chamber insulation arrangement shown in FIG. 1 has struts with a bend, which is described in the following text with reference to FIG. 2.

Figure 2:
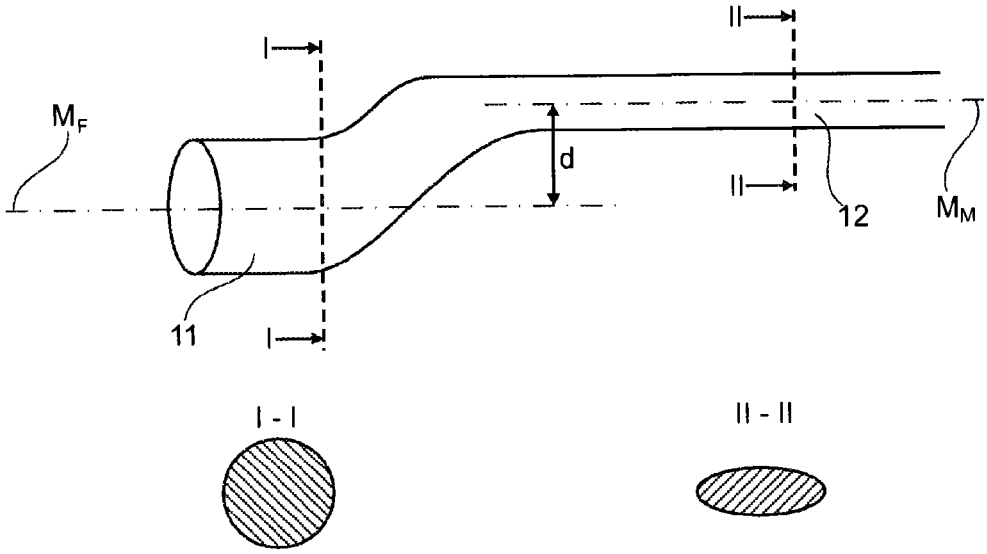
FIG. 2 shows a detailed view of a center part and of a foot area of a strut with corresponding cross-sectional views according to an exemplary embodiment of the present disclosure.

FIG. 2 shows a detailed view of a foot area 11 of a strut 10 and a center area 12 of a strut. The center axis $M_F$ of the foot area 11 has been shifted through a distance d with respect to the center axis $M_M$ of the center area 12, with the two center axis $M_F$ and $M_M$ running parallel to one another in the illustrated exemplary embodiment.

As can be seen from the cross sections I-I and II-II, a circular cross section can be chosen, by way of example, in a foot area 11, by way of example, while an elongated cross section, for example an oval or kidney-shaped cross section, can be chosen in a center area 12. In this case, the round cross section is good for attachment, while the elongated cross section in the center area allows a space-optimized strut arrangement in this center area.

Figure 3:
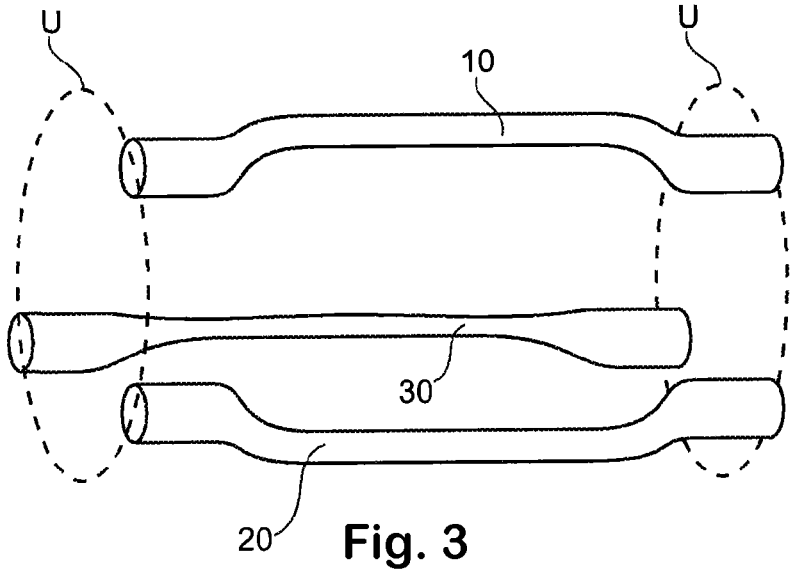
FIGS. 3 to 9 show various refinements of a switching chamber insulation arrangement and of a strut arrangement according to various exemplary embodiments of the present disclosure.

FIG. 3 shows a strut arrangement with three struts 10, 20, 30, which in this exemplary embodiment, are arranged uniformly along a circumference U. In this case, in a similar manner to that in FIG. 1, the struts shown in FIG. 3 are bent such that a center area of the struts is located radially further outward than a corresponding foot point area.

Figure 4:
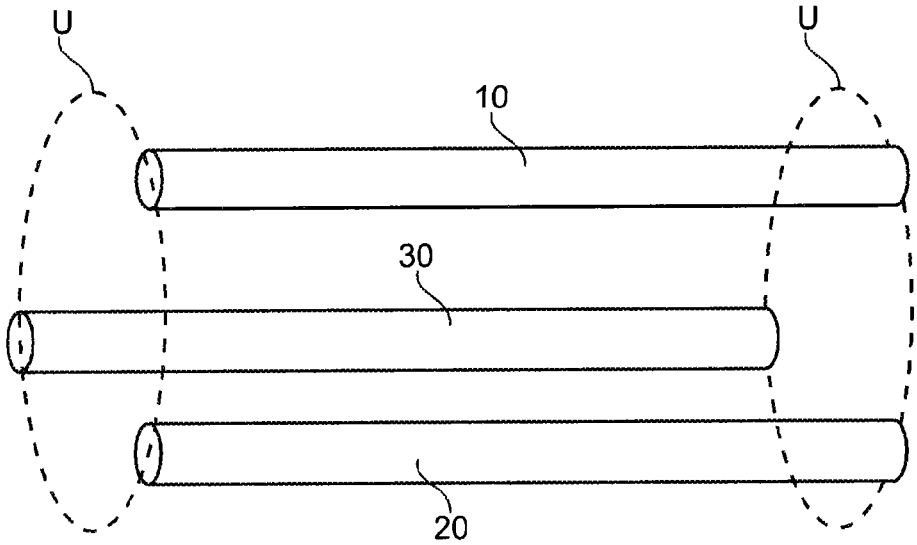

FIG. 4 shows an analogous arrangement with three struts 10, 20, 30, which are likewise arranged regularly along a circumference U, but with the struts not having a bend, which can simplify the production of the struts. An arrangement such as this can be used, for example, when a space-saving arrangement is not important. It should be understood that the struts may be, for example, circular-cylindrical, although they may likewise have a cylindrical shape with an elongated cross section, or else a circular-cylindrical foot area and an elongated center area.

Figure 5:
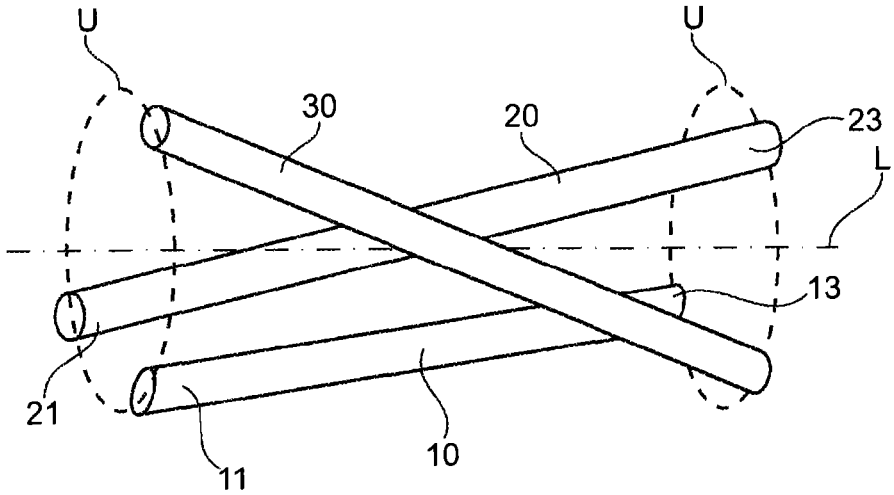

FIG. 5 likewise shows an exemplary strut arrangement having three struts 10, 20, 30, but with the corresponding foot areas 11, 21 having been shifted along the circumference with respect to the associated foot areas 13, 23. This configuration leads to the struts 10, 20, 30 running obliquely or inclined with respect to the longitudinal extent axis L. This configuration lengthens the creepage distance along the surface of the struts, in which case the distance between the two planes on which the foot points 11, 21 and 13, 23 open, is substantially unchanged. The struts shown in FIG. 5 may, of course, also be bent.

Figure 6:
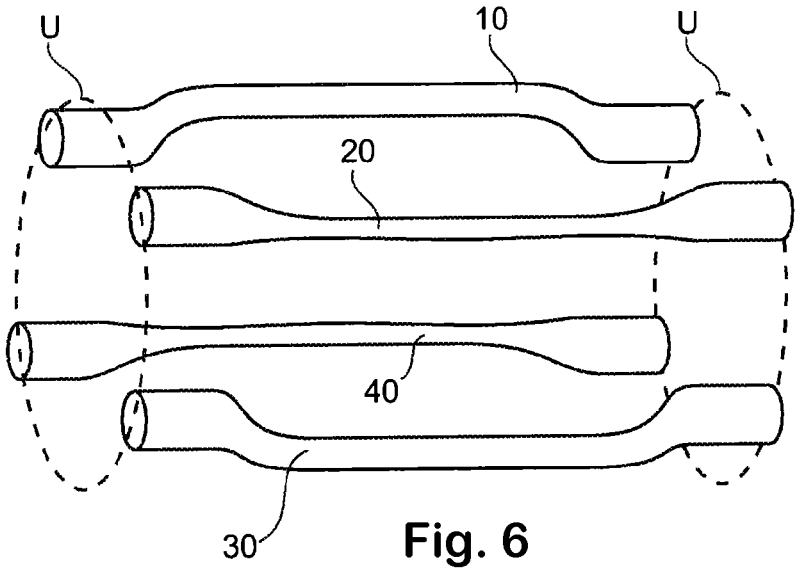

FIG. 6 shows an exemplary arrangement having four struts of a strut arrangement, with the four struts 10, 20, 30, 40 likewise being arranged uniformly along a circumference U. This allows greater robustness and, furthermore, a certain amount of redundancy in the event of a strut breaking, without a three-point suspension being lost in the process.

Figure 7:
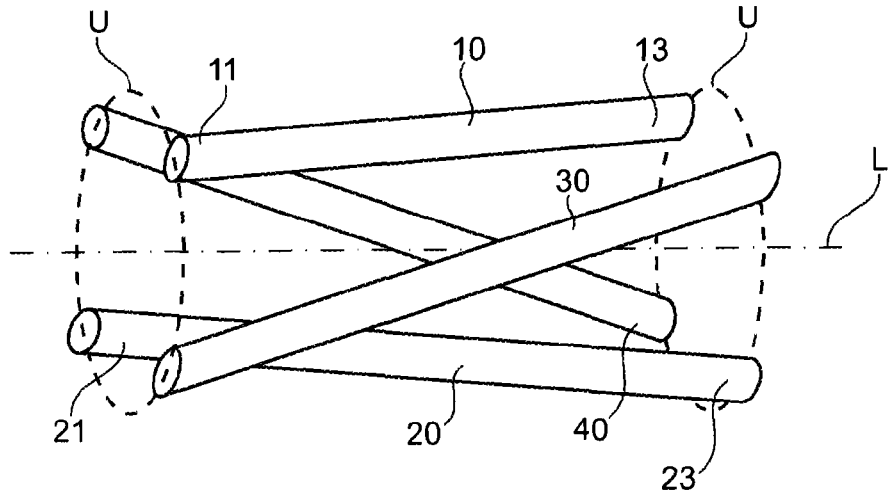

FIG. 7 shows an analogous arrangement having four struts, which, analogously to FIG. 5, has foot points 11, 21 on the one hand and 13, 23 on the other hand rotated with respect to one another. This results in the struts 10, 20, 30, 40 being inclined with respect to the longitudinal extent axis U.

Figure 8:
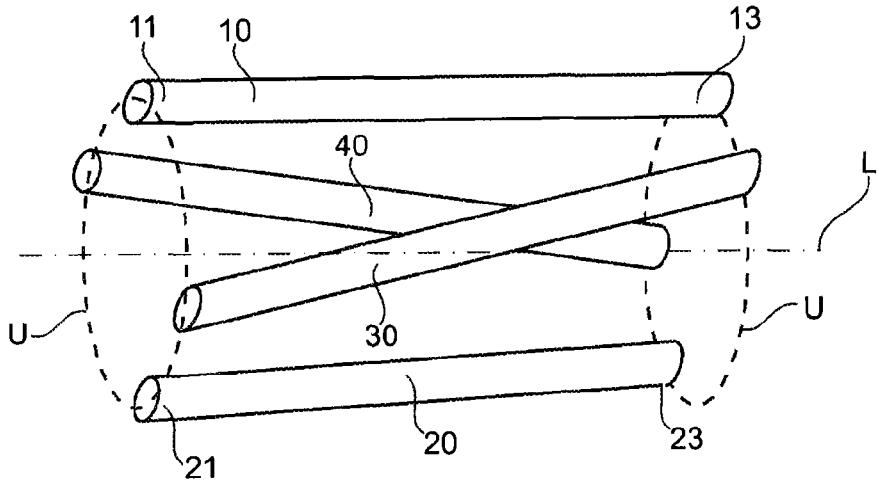

FIG. 8 likewise shows an exemplary strut arrangement having four struts 10, 20, 30, 40, but with the corresponding struts being inclined alternately in opposite senses with respect to one another, as a result of which the foot points 11, 21 and 13, 23 are no longer distributed uniformly along the circumference. However, this configuration results in a strut arrangement which is relatively resistant to torsion, since the struts are loaded alternately in tension and compression when a torsion load is applied.

Figure 9:
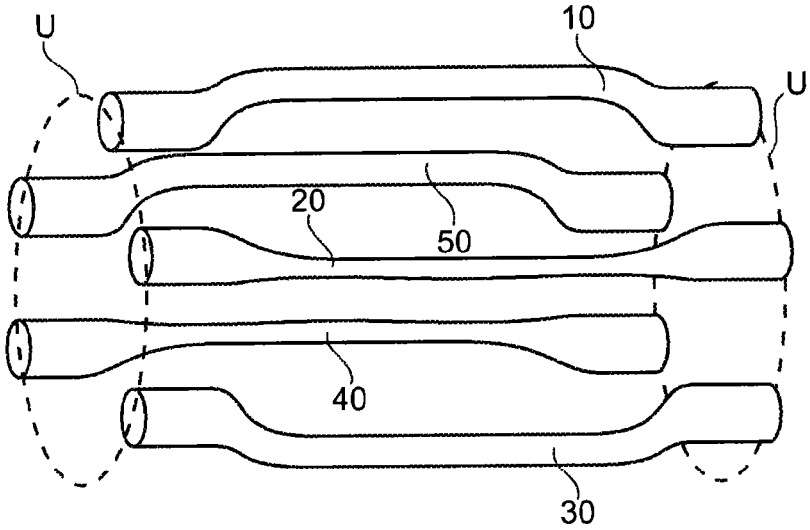

FIG. 9 shows an exemplary arrangement with a total of five struts 10, 20, 30, 40, 50, with the foot points once again being arranged distributed uniformly along the circumference U in the arrangement shown in FIG. 9. By way of example, this configuration allows the struts to be made thinner, and provides a redundant system in the event of a strut breaking. It should be understood that, of course, it is also possible to use more than five struts.

Figure 10:
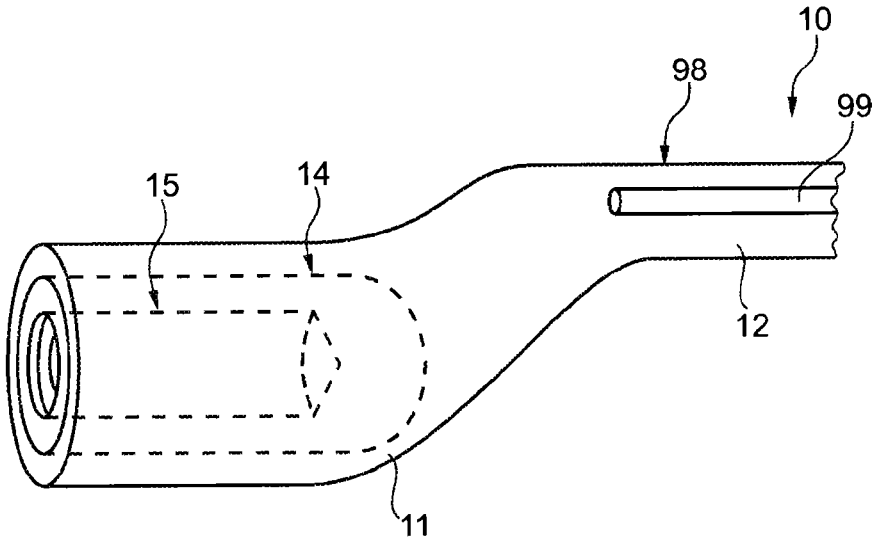
FIG. 10 shows a detailed view of a foot area and of a center area of a strut arrangement with elements inserted according to an exemplary embodiment of the present disclosure.

FIG. 10 shows a detailed view of a foot area of a strut 10 in which the foot area 11 has been bent with respect to the center area 12. In this case, a field control arrangement 14 in the form of an outer surface with slight surface curvature and without sharp edges is located in the foot area 11. A mechanical attachment 15 is provided within this arrangement, and represents a cut thread in the arrangement shown here. The mechanical attachment may, of course, also include a bayonet fitting and/or a clamping connection, and/or a bolt which projects axially out of the strut foot area. An arrangement such as this with a mechanical attachment 15 and a field control surface 14 may, for example, be formed integrally. For example, this can be done by means of a metal part, and/or else by means of a plastic part which is provided with a conductive additive, thus allowing specific field control characteristics to be achieved. The center area 12 may in this case furthermore be provided with mechanical reinforcement 99 which, for example, may be a fiber reinforcing insert, a composite material tube, or a strut or the like. It should be understood that the reinforcement 99 and the field control arrangement 14 need not necessarily be provided at the same time in one strut, but that only one of the two arrangements may also be provided. Furthermore, it should be understood that the field control arrangement 14 and the reinforcement arrangement 99 can also be used with struts that are not bent. The reinforcement arrangement may also be connected to the field control arrangements on both sides of the strut, in order to ensure that the foot areas are positioned, for example, before and during an encapsulation process. In addition, the strut can be provided with a coating 98 which, for example, represents a diffusion barrier. In this case the coating may cover the entire surface of the strut, or else may be provided only in areas of the struts and/or of the strut arrangement.

Figure 11:
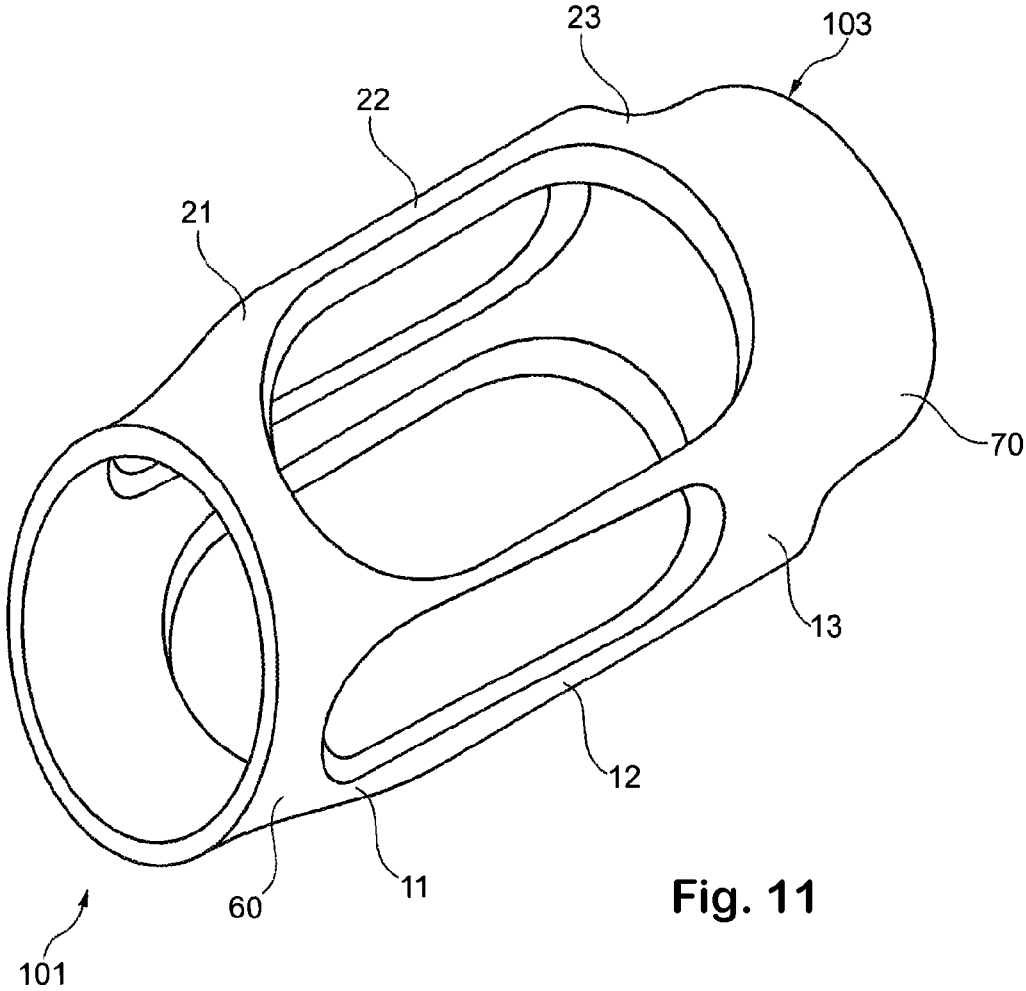
FIG. 11 shows a switching chamber insulation arrangement with supporting rings according to an exemplary embodiment of the present disclosure.

FIG. 11 shows an exemplary embodiment of a switching chamber insulation arrangement, in which each of the struts is formed integrally with a first supporting ring 60 or a second supporting ring 70. The coupling area 101 may in this case be formed in the area of the first supporting ring 60, while the second coupling area 103 may be formed in the area of the second supporting ring 70. The foot areas 11, 21 and 13, 23 of the struts may in this case end in the corresponding respective supporting ring 60, 70, and may be formed integrally with the corresponding center areas 12, 22. It should be understood that the struts may also have a round or elongated cross section, and that the struts can likewise run obliquely, and need not necessarily be provided parallel to the longitudinal extent direction of the switching chamber insulation arrangement.

Figure 12:
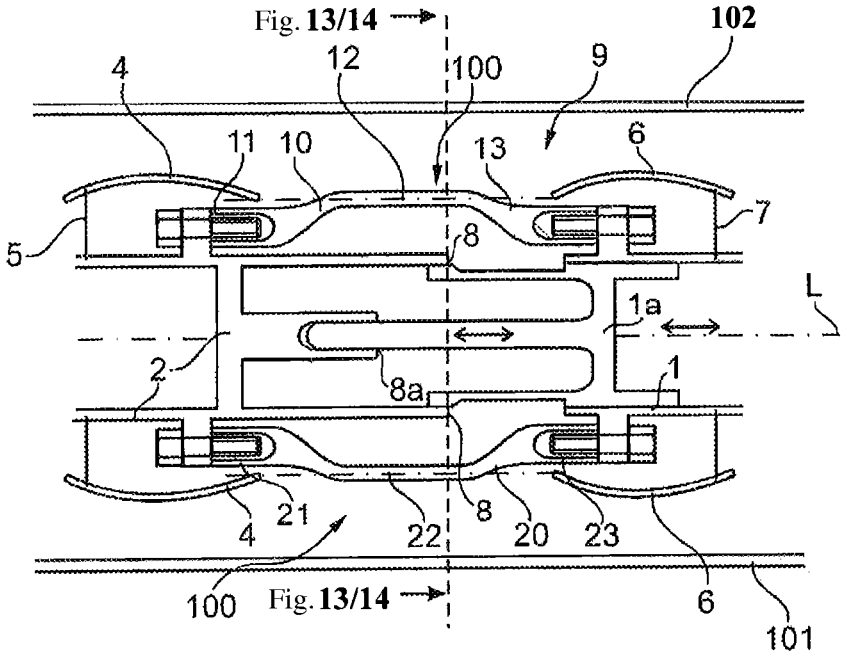
FIG. 12 shows a section view through a part of a gas-insulated circuit breaker having a switching chamber insulation arrangement according to an exemplary embodiment of the present disclosure.

FIG. 12 shows a section view through an area of a gas-insulated circuit breaker according to an exemplary embodiment of the present disclosure. In this exemplary embodiment, the circuit breaker has a housing 111 which surrounds a gas area. The two contact poles 1 and 2 of the circuit breaker are located within the gas area. In the embodiment shown in FIG. 12, the first contact pole 1 has a moving part 1*a*, which can be moved axially along a longitudinal extent direction L. During movement of the moving part 1*a*, in the embodiment shown here, the rated current contacts 8 are opened first, as a result of which the current is commutated onto the arcing contact 8*a*. As they move further axially apart from one another, the arcing contact 8*a* then opens. This allows the current to be commutated from the rated current contacts 8 onto the arcing contact 8*a* during opening, thus allowing the current to be reliably quenched in this area. This means that the rated current contacts 8 are not loaded by the arc that occurs during opening and which, in the embodiment illustrated here, loads only the arcing contacts 8*a*. This configuration can also reduce the amount of heat developed by maintaining the contact areas of the rated current contacts 8. The struts 10, 20 each have center areas 12, 22, whose center axes are shifted radially outward with respect to the center axes of the foot points 11, 21 and 13, 23. The foot points are attached to the respective contact poles 1, 2 of the circuit breaker, in this case by way of example by a screw connection. The field peak caused by the screw edges, for example, can be compensated for by covering the foot point areas 11, 21, 13, 23 by corresponding field control elements 4, 6, which are connected in an appropriately conductive manner via a conductive connection 5 or 7 to the corresponding contact poles 1, 2. This makes it possible to substantially avoid impermissible fuel peaks, in particular with respect to the outer housing 102.

Figure 13:
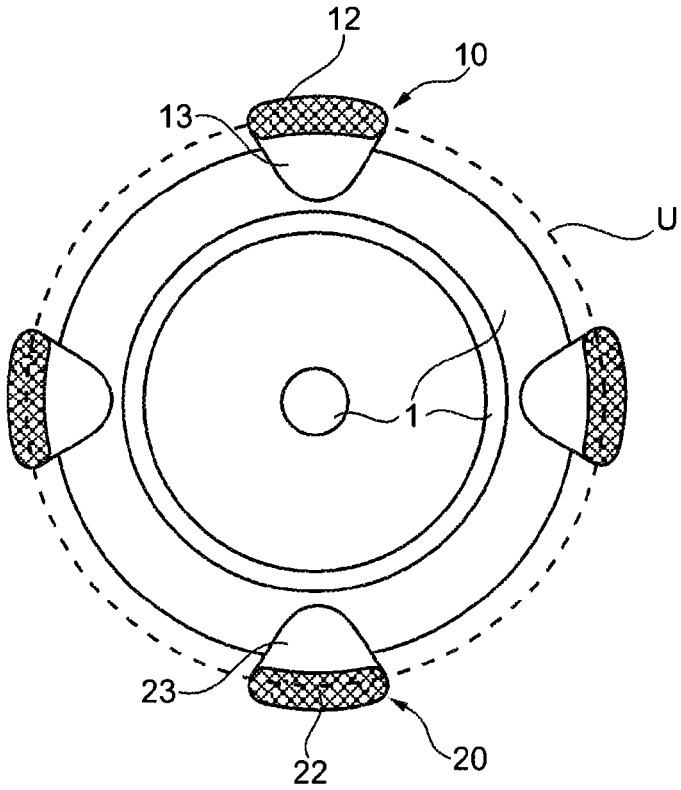
FIGS. 13 and 14 show a section view of the section axis, as shown in FIG. 12, according to various exemplary embodiments of the present disclosure.

FIG. 13 shows a section view through the switching chamber insulation arrangement with the associated contacts along a separating line which is shown in a corresponding manner in FIG. 12. In this case, the struts 10, 20 have corresponding center areas 12, 22, which are elongated. The foot areas 13, 23 are bent with respect to the center areas, and therefore have a center point which is located radially further inward. In the exemplary embodiment illustrated in FIG. 13, the struts may be manufactured from a polymer resin, for example.

Figure 14:
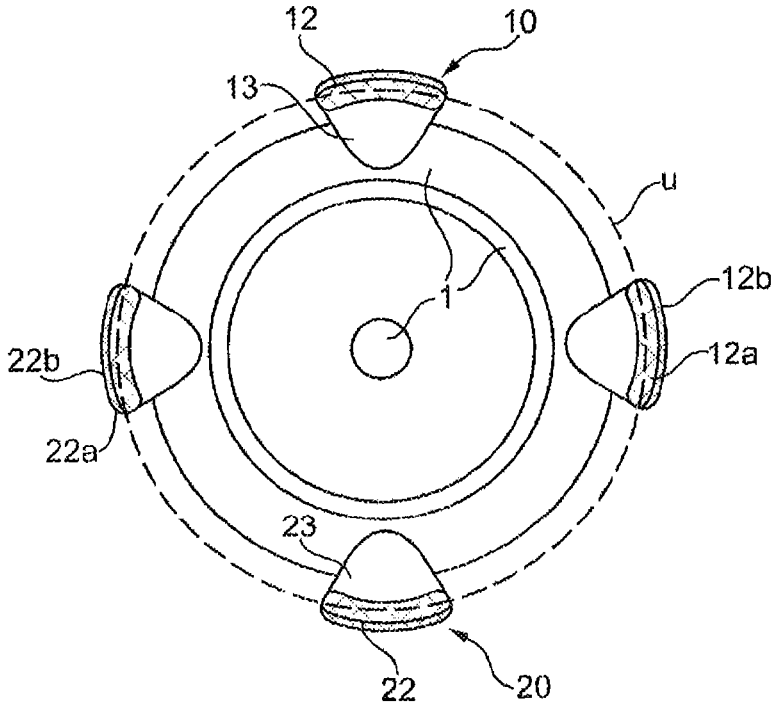

FIG. 14 shows another exemplary embodiment of the present disclosure, in which the center areas 12, 22 of the struts 10, 20 have been arranged shifted, that is to say bent (analogously to FIG. 13). In this case, by way of example, the center area 12, 22 can be provided with a shell 12*b*, 22*b*, which is located radially on the outside. In this case, radially on the outside means with respect to the individual strut, but can also be understood as meaning with respect to the entire switching chamber insulation arrangement. In the first case, the shell 12*b*, 22*b* may, for example, also be arranged along the entire circumference of the center area of the strut, but may also be in the form of a half-shell, as is shown in FIG. 14. The inner area, that is to say radially on the inside, with respect either to the strut or else within the switching chamber insulation arrangement, may in this case be provided with a filling material 12*a*, 22*a*. This makes it possible to produce a switching chamber insulation arrangement which is particularly resistant to tension and compression forces.

It should be noted that the term "comprising" does not exclude further elements, and the term "one" does not exclude "a" plurality of elements. The reference symbols used serve only to assist understanding and should in no way be considered as being restrictive, with the scope of protection of the disclosure being reflected by the claims.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A switching chamber insulation arrangement comprising a strut arrangement having a plurality of struts, wherein:

each strut has a first foot area, a second foot area, and a center area located between the first foot area and the second foot area, respectively;

the struts are arranged along a circumference around a longitudinal extent axis of the strut arrangement;

the center area of each of the struts is bent radially outward from the first foot area and the second foot area of each respective strut;

the strut arrangement has a first mechanical coupling area on a side of the first foot areas for coupling to a first pole of a circuit breaker, and a second mechanical coupling area on a side of the second foot areas for coupling to a second pole of a circuit breaker.

2. The switching chamber insulation arrangement as claimed in claim 1, wherein the struts have an elongated cross section in the center area, respectively.

3. The switching chamber insulation arrangement as claimed in claim'1, wherein the respective first foot areas and the respective second foot areas are bent through a distance with respect to the corresponding center areas, in a radial direction of the switching chamber insulation arrangement with respect to the longitudinal extent axis.

4. The switching chamber insulation arrangement as claimed in claim 1, wherein the first foot area of a respective strut is shifted along the circumference with respect to the associated second foot area of the respective strut, such that the struts are inclined with respect to the longitudinal extent axis.

5. The switching chamber insulation arrangement as claimed in claim 1, wherein the strut arrangement has at least three struts.

6. The switching chamber insulation arrangement as claimed in claim 1, wherein the strut arrangement has at least four struts, and wherein the struts are inclined alternately in opposite senses with respect to a longitudinal extent direction to provide stiffening in a circumferential direction around the longitudinal extent axis.

7. The switching chamber insulation arrangement as claimed in claim 1, comprising:

a field control electrode respectively embedded in the first foot area and in the second foot area of each strut; and a force absorption apparatus arranged within each field control electrode, respectively.

8. The switching chamber insulation arrangement as claimed in claim 1, wherein the first foot areas of the struts are each formed integrally with a first supporting ring, and the second foot areas are each formed integrally with a second supporting ring.

9. The switching chamber insulation arrangement as claimed in claim 1, wherein the strut arrangement has a polymer resin, and has a metal-oxide-filled polymer resin in at least one section of an electrical isolating gap.

10. The switching chamber insulation arrangement as claimed in claim 1, wherein the center area of at least one strut comprises a shell which is located radially outside the respective strut, and a filling which is located radially within the respective strut.

11. The switching chamber insulation arrangement as claimed in claim 1, wherein the circumference is substantially circular.

12. The switching chamber insulation arrangement as claimed in claim 1, wherein at least a part of the strut arrangement is coated with a diffusion barrier.

13. A circuit breaker comprising:

a switching chamber insulation arrangement as claimed in claim 1, a first switch contact pole; and a second switch contact pole, wherein the circuit breaker is a single-phase-encapsulated circuit breaker.

14. The circuit breaker as claimed in claim 13, comprising:

a first field control cover which is arranged at a rated current contact junction, the first field control cover being connected, carrying potential, to at least one of the first switch contact pole and the second switch contact pole, wherein the first mechanical coupling area is mechanically connected to the first switch contact pole at at least one of the first switch contact pole and the second switch contact pole, under the first field control cover.

15. The switching chamber insulation arrangement as claimed in claim 1, wherein the switching chamber insulation arrangement is configured to be installed in a single-phase-encapsulated circuit breaker.

16. The switching chamber insulation arrangement as claimed in claim 2, wherein the respective first foot areas and the respective second foot areas are bent through a distance with respect to the corresponding center areas, in a radial direction of the switching chamber insulation arrangement with respect to the longitudinal extent axis.

17. The switching chamber insulation arrangement as claimed in claim 16, wherein the first foot area of a respective strut is shifted along the circumference with respect to the associated second foot area of the respective strut, such that the struts are inclined with respect to the longitudinal extent axis.

18. The switching chamber insulation arrangement as claimed in claim 17, wherein the strut arrangement has at least three struts.

19. The switching chamber insulation arrangement as claimed in claim 17, wherein the strut arrangement has at least four struts, and wherein the struts are inclined alternately in opposite senses with respect to a longitudinal extent direction to provide stiffening in a circumferential direction around the longitudinal extent axis.

20. The switching chamber insulation arrangement as claimed in claim 17, comprising:

a field control electrode respectively embedded in the first foot area and in the second foot area of each strut; and a force absorption apparatus arranged within each field control electrode, respectively.

21. The switching chamber insulation arrangement as claimed in claim 20, wherein the first foot areas of the struts are each formed integrally with a first supporting ring, and the second foot areas are each formed integrally with a second supporting ring.

22. The switching chamber insulation arrangement as claimed in claim 21, wherein the strut arrangement has a polymer resin, and has a metal-oxide-filled polymer resin in at least one section of an electrical isolating gap.

23. The switching chamber insulation arrangement as claimed in claim 22, wherein the center area of at least one strut comprises a shell which is located radially outside the respective strut, and a filling which is located radially within the respective strut.

24. The switching chamber insulation arrangement as claimed in claim 17, wherein the circumference is substantially circular.

25. The switching chamber insulation arrangement as claimed in claim 17, wherein at least a part of the strut arrangement is coated with a diffusion barrier.

26. A circuit breaker comprising:

a switching chamber insulation arrangement as claimed in claim 23, a first switch contact pole; and a second switch contact pole, wherein the circuit breaker is a single-phase-encapsulated circuit breaker.

27. The circuit breaker as claimed in claim 26, comprising:

a first field control cover which is arranged at a rated current contact junction, the first field control cover being connected, carrying potential, to at least one of the first switch contact pole and the second switch contact pole, wherein the first mechanical coupling area is mechanically connected to the first switch contact pole at at least one of the first switch contact pole and the second switch contact pole, under the first field control cover.

28. The switching chamber insulation arrangement as claimed in claim 1, wherein the first foot area and the second foot area of each of the struts have a first center axis displaced a first radial distance from the longitudinal extent axis, and the center area of each of the struts has a second center axis substantially parallel to the first center axis and displaced a second radial distance from longitudinal extent axis, the second radial distance being greater than first radial distance.

29. The switching chamber insulation arrangement according to claim 1, wherein the center area of each of the struts in said strut arrangement has a radial thickness less than a radial thickness of the first and second foot areas.

30. The switching chamber insulation arrangement according to claim 1, wherein the first and second foot areas of each of the struts has a substantially circular cross section, and wherein the center area of each of the struts has a concave inner surface and a convex outer surface.

31. A switching chamber insulation arrangement, comprising:

a strut arrangement comprising a plurality of struts, wherein each of the plurality of struts has a first foot area, a second foot area, and a center area located between the first foot area and the second foot area, respectively;

the center area of each of the plurality of struts in said strut arrangement having a radial thickness less than a radial thickness of the first and second foot areas;

each of the plurality of struts being arranged along a circumference around a longitudinal extent axis of the strut arrangement; and said strut arrangement having at least one first mechanical coupling area on a side of the first foot areas for coupling to a first pole of a circuit breaker, and at least one second mechanical coupling area on a side of the second foot areas for coupling to a second pole of a circuit breaker.

32. The switching chamber insulation arrangement according to claim 31, wherein the first foot area and the second foot area of each of the plurality of struts have a first center axis displaced a first radial distance from the longitudinal extent axis, and the center area of each of the plurality of struts has a second center axis substantially parallel to the first center axis and displaced a second radial distance from longitudinal extent axis, the second radial distance being greater than first radial distance.

33. The switching chamber insulation arrangement according to claim 31, wherein the first and second foot areas of each of the plurality of struts has a substantially circular cross section, and wherein the center area of each of the plurality of struts has a concave inner surface and a convex outer surface.

34. The switching chamber insulation arrangement according to claim 31, wherein the first and second foot areas of each of the plurality of struts has a substantially circular cross section, and wherein the center area of each of the plurality of struts has a kidney shaped cross section.

35. A switching chamber insulation arrangement, comprising:

a strut arrangement comprising a plurality of struts, wherein each of the plurality of struts has a first foot area, a second foot area, and a center area located between the first foot area and the second foot area, respectively;

the first and second foot areas of each of the plurality of struts having a substantially circular cross section;

each of the plurality of struts being arranged along a circumference around a longitudinal extent axis of the strut arrangement; and said strut arrangement having at least one first mechanical coupling area on a side of the first foot areas for coupling to a first pole of a circuit breaker, and at least one second mechanical coupling area on a side of the second foot areas for coupling to a second pole of a circuit breaker.

36. The switching chamber insulation arrangement according to claim 35, wherein the center area of each of the plurality of struts in said strut arrangement has an elliptical cross section.

37. The switching chamber insulation arrangement according to claim 35, wherein the center area of each of the plurality of struts in said strut arrangement has a kidney shaped cross section.

38. The switching chamber insulation arrangement according to claim 35, wherein the center area of each of the plurality of struts in said strut arrangement has a concave inner surface and a convex outer surface.

39. The switching chamber insulation arrangement according to claim 35, wherein the first foot area and the second foot area of each of the plurality of struts have a first center axis displaced a first radial distance from the longitudinal extent axis, and the center area of each of the plurality of struts has a second center axis substantially parallel to the first center axis and displaced a second radial distance from longitudinal extent axis, the second radial distance being greater than first radial distance.

40. A switching chamber insulation arrangement, comprising:

a strut arrangement comprising a plurality of struts, wherein each of the plurality of struts has a first foot area, a second foot area, and a center area located between the first foot area and the second foot area, respectively;

the center area of each of the plurality struts being bent radially outward from the first foot area and the second foot area of each respective strut;

the first and second foot areas of each of the plurality of struts having a substantially circular cross section;

each of the plurality of struts being arranged along a circumference around a longitudinal extent axis of the strut arrangement; and each of the plurality of struts having a first mechanical attachment on the first foot area for coupling to a first pole of a circuit breaker and a second mechanical attachment on the second foot area for coupling to a second pole of a circuit breaker.

41. The switching chamber insulation arrangement according to claim 40, wherein each of the first and second mechanical attachments comprise at least one of a threaded cavity, a bayonet fitting and an axially projecting bolt.

* * * * *